US007783241B2

(12) United States Patent
Iwaishi et al.

(10) Patent No.: US 7,783,241 B2
(45) Date of Patent: Aug. 24, 2010

(54) REFLECTION MEMBER FOR A FIXING UNIT OF AN, IMAGE FORMING APPARATUS AND A FIXING METHOD USING THE REFLECTION MEMBER

(75) Inventors: Akira Iwaishi, Ebina (JP); Hiroshi Nou, Ebina (JP); Mitsuhiro Mori, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 121 days.

(21) Appl. No.: 12/019,787

(22) Filed: Jan. 25, 2008

(65) Prior Publication Data

US 2008/0304883 A1 Dec. 11, 2008

(30) Foreign Application Priority Data

Jun. 11, 2007 (JP) ..... 2007-153814

(51) Int. Cl.
*G03G 15/20* (2006.01)

(52) U.S. Cl. ..... 399/336

(58) Field of Classification Search ..... 399/336, 399/335; 219/216

See application file for complete search history.

(56) References Cited

U.S. PATENT DOCUMENTS 5,448,344 A * 9/1995 Itakura et al. ..... 399/336
6,813,465 B2 * 11/2004 Kishimoto et al. ..... 399/336

FOREIGN PATENT DOCUMENTS

JP 60102675 A * 6/1985
JP 60107068 A * 6/1985
JP 60-252383 A 12/1985
JP 06003984 A * 1/1994

* cited by examiner

*Primary Examiner*—Quana M Grainger
(74) *Attorney, Agent, or Firm*—Sughrue Mion, PLLC

(57) ABSTRACT

The fixing apparatus used in an image forming apparatus and fixing an image on a recording medium, the fixing apparatus is provided with: a flash lamp that emits flash light for fixing the image; and a reflection member that has a reflection surface reflecting the flash light emitted from the flash lamp to the recording medium. A shape of the reflection surface is configured so as to be deformable.

7 Claims, 11 Drawing Sheets

| FLASH LAMP 51 | FIRST STAGE | MIDDLE STAGE | LAST STAGE |
|---|---|---|---|
| ANGLE OF REFELCTION SURFACE | STAGE A | STAGE B | STAGE C |
| MAXIMUM VALUE | 0.311 | 0.290 | 0.277 |
| MINIMUM VALUE | 0.300 | 0.280 | 0.265 |
| AVERAGE VALUE | 0.306 | 0.284 | 0.269 |
| MAXIMUM VALUE−MINIMUM VALUE | 0.011 | 0.010 | 0.011 |

| FLASH LAMP 51 | FIRST STAGE | LAST STAGE |
|---|---|---|
| ANGLE OF REFLCTION SURFACE | STAGE C | STAGE C |
| MAXIMUM VALUE | 0.318 | 0.277 |
| MINIMUM VALUE | 0.300 | 0.266 |
| AVERAGE VALUE | 0.308 | 0.269 |
| MAXIMUM VALUE — MINIMUM VALUE | 0.018 | 0.011 |

REFLECTION MEMBER FOR A FIXING UNIT OF AN, IMAGE FORMING APPARATUS AND A FIXING METHOD USING THE REFLECTION MEMBER

CROSS REFERENCE TO RELATED APPLICATIONS

This application is based on and claims priority under 35 USC §119 from Japanese Patent Application No. 2007-153814 filed Jun. 11, 2007.

BACKGROUND

1. Technical Field

The present invention relates to a fixing apparatus, an image forming apparatus and a fixing method.

2. Related Art

There is known a flash fixing apparatus that is provided with a reflection surface reflecting light emitted from a flash lamp on the recording medium side.

SUMMARY

According to an aspect of the invention, there is provided a fixing apparatus used in an image forming apparatus and fixing an image on a recording medium, the fixing apparatus including: a flash lamp that emits flash light for fixing the image; and a reflection member that has a reflection surface reflecting the flash light emitted from the flash lamp to the recording medium, a shape of the reflection surface being configured so as to be deformable.

BRIEF DESCRIPTION OF THE DRAWINGS

Exemplary embodiment (s) of the present invention will be described in detail based on the following figures, wherein.

DETAILED DESCRIPTION

A exemplary embodiment of the present invention will be described in detail below with reference to the accompanying drawings.

Figure 1:
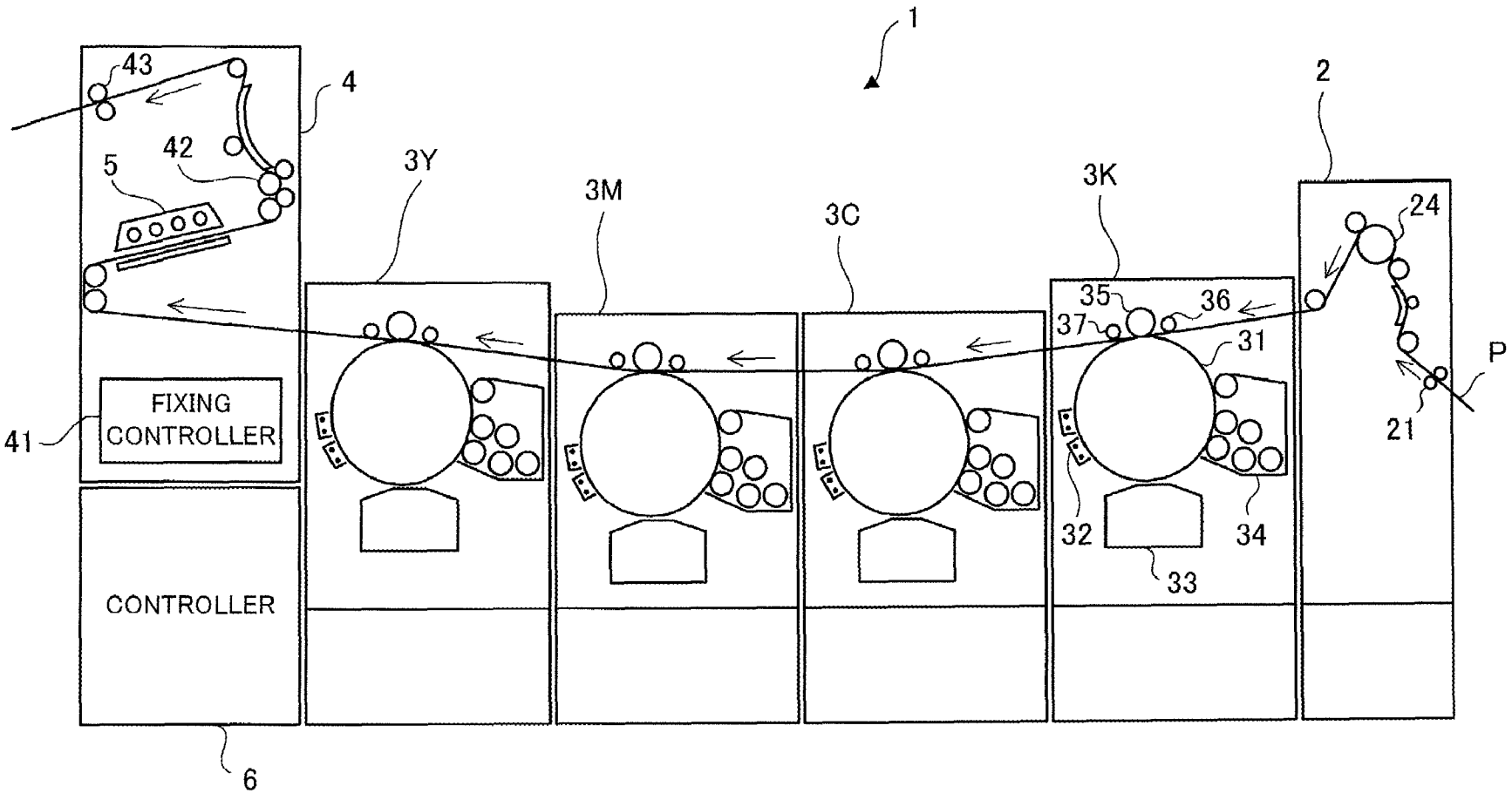
FIG. 1 is a diagram that illustrates the overall configuration of an image forming apparatus to which the exemplary embodiment is applied.

FIG. 1 is a diagram that illustrates the overall configuration of an image forming apparatus 1 to which the exemplary embodiment is applied. This image forming apparatus 1 is a so-called continuous form printer that forms an image on a continuous paper P that is a medium formed into a belt shape. The image forming apparatus 1 is provided with, from the upstream side in the transportation direction (an arrow in the figure) of the continuous paper P as a recording medium towards the downstream side, a paper transporting unit 2 constitutes a part of a transportation unit that transports and drives the continuous paper P, and a K-color image forming unit 3K that forms a toner image of black (K) on the continuous paper P, a C-color image forming unit 3C that forms a toner image of cyan (C) on the continuous paper P, a M-color image forming unit 3M that forms a toner image of magenta (M) on the continuous paper P, and a Y-color image forming unit 3Y that forms a toner image of yellow (Y) on the continuous paper P, a fixing unit 4 that fixes the color toner images, and a controller 6 that controls the entire image forming apparatus 1.

In the paper transporting unit 2, from the upstream side to the downstream side in the transportation direction of the continuous paper P, a back tension rolls 21 and a main drive roll 24 are arranged.

The main drive roll 24 has a function of nipping the continuous paper P with a predetermined pressure, receiving drive from a main motor (not shown in the figure) that is arranged in the paper transporting unit 2, and feeding the continuous paper P at a predetermined transportation speed to the downstream side in the transportation direction of the continuous paper P. The back tension rolls 21 have a function of rotating at a lower speed than that of the main drive roll 24 and giving the tensile force to the continuous paper P on the upstream side of the main drive roll 24.

Each of the K-color image forming unit 3K, the C-color image forming unit 3C, the M-color image forming unit 3M, and the Y-color image forming unit 3Y is provided with a photoconductor drum 31, an electrically charging corotron 32 that electrically charges a surface of the photoconductor drum 31 at a predetermined potential, a laser exposure device 33 that exposes the surface of the photoconductor drum 31 on the basis of the image data, a developing device 34 that develops an electrostatic latent image formed on the surface of the photoconductor drum 31 by each of the color toners, a transfer roll 35 that transfers the toner image as an image formed on the surface of the photoconductor drum 31 to the continuous paper P, and a pair of transfer guiding rolls 36 and 37 that are arranged on the upstream side and the downstream side of the transfer roll 35 respectively, and press the continuous paper P onto the photoconductor drum 31.

The fixing unit 4 includes a flash fixing apparatus 5 that functions as a fixing apparatus that fixes each color toner image formed on the continuous paper P, a fixing controller 41 that executes control of the flash fixing apparatus 5 by receiving an instruction from the controller 6, a tensile force application roll 42 that applies tension to the continuous paper P on the downstream side of the flash fixing apparatus 5, and a tension roll 43 that nips the continuous paper P in proximity to an outlet, rotates at a peripheral speed faster than a carrying speed of the continuous paper P, and applies tension to the continuous paper P.

The controller 6 controls the paper transporting unit 2, the K-color image forming unit 3K, the C-color image forming unit 3C, the M-color image forming unit 3M, the Y-color image forming unit 3Y, and the fixing unit 4.

Next, a description is given to an image forming action by the image forming apparatus 1.

When the image forming apparatus 1 receives an instruction for printing an image, the controller 6 receives the image data.

In synchronization with the receipt of the image data by the controller 6, the controller 6 controls the paper transporting unit 2 and the fixing unit 4. The paper transporting unit 2 and the fixing unit 4 that are controlled by the controller 6 transport the continuous paper P at a predetermined transportation speed while giving a predetermined tensile force to the continuous paper P.

Further, the controller 6 separates the received image data into image data corresponding to a K color, a C color, an M color and a Y color respectively. Then, based on the image data on the K color, the C color, the M color and the Y color, the controller 6 forms a toner image on the continuous paper P in the K-color image forming unit 3K, the C-color image forming unit 3C, the M-color image forming unit 3M and the Y-color image forming unit 3Y respectively.

In each of the K-color image forming unit 3K, the C-color image forming unit 3C, the M-color image forming unit 3M, and the Y-color image forming unit 3Y, a photoconductor drum 31 starts rotation. The surface of the photoconductor drum 31 is charged at a predetermined electric potential by the electrically charging corotron 32. Then, an electrostatic latent image corresponding to the respective color image data is formed by the laser exposing unit 33. Further, the electrostatic latent image on the photoconductor drum 31 is developed by respective color toners in a developing instrument 34 to form the toner image on the surface of the photoconductor drum 31. Thereafter, the toner image formed on the surface of the photoconductor drum 31 is transferred to the continuous paper P by a transfer roll 35.

In the image forming apparatus 1, the continuous paper P successively passes through the K-color image forming unit 3K, the C-color image forming unit 3C, the M-color image forming unit 3M, and the Y-color image forming unit 3Y (3K→3C→3M→3Y). Thereby, on the continuous paper P, the color toner images are formed by superimposing the K-color toner image, the C-color toner image, the M-color toner image and the Y-color toner image in sequence. In this way, in the color image forming units 3K, 3C, 3M and 3Y, a full color toner image is formed on the continuous paper P.

After that, the continuous paper P on which the full color toner image is formed is transported to the fixing unit 4. The toner image formed on the continuous paper P is fixed on the continuous paper P by the flush fixing device 5. As mentioned above, the full color image is formed on the continuous paper P.

First Exemplary Embodiment

Figure 2A:
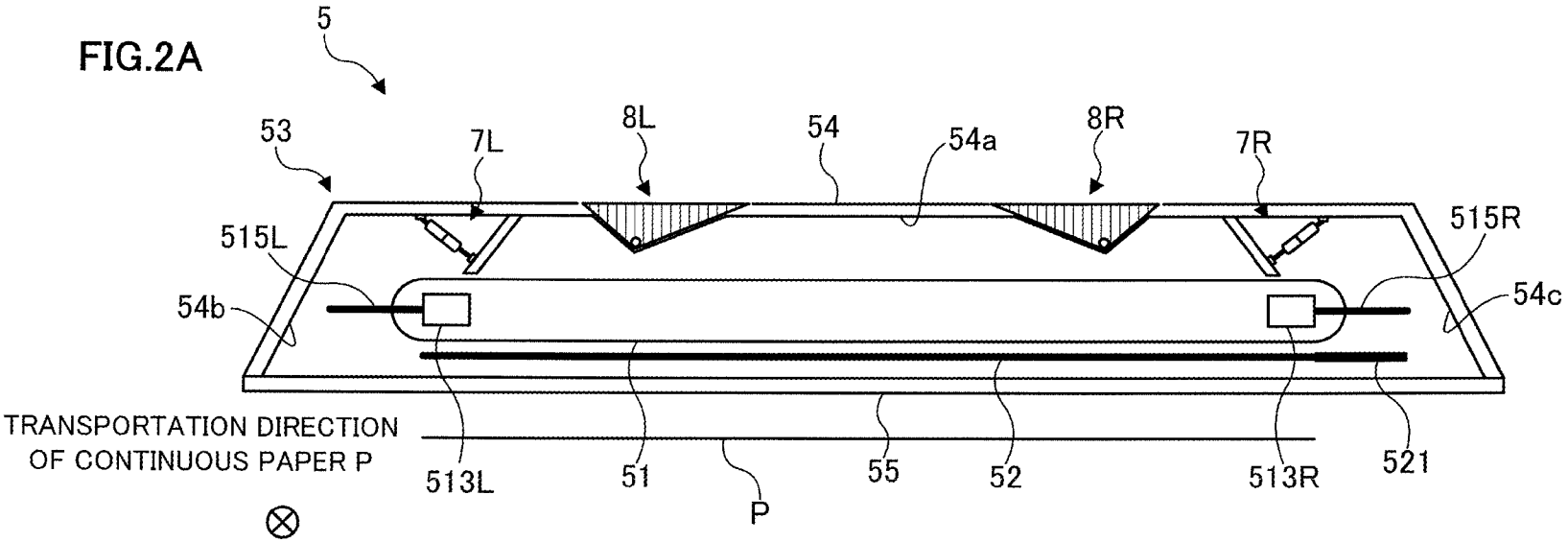
FIG. 2A shows a side view of the flash fixing apparatus viewing from the upstream side in a transportation direction of the continuous paper.
Figure 2B:
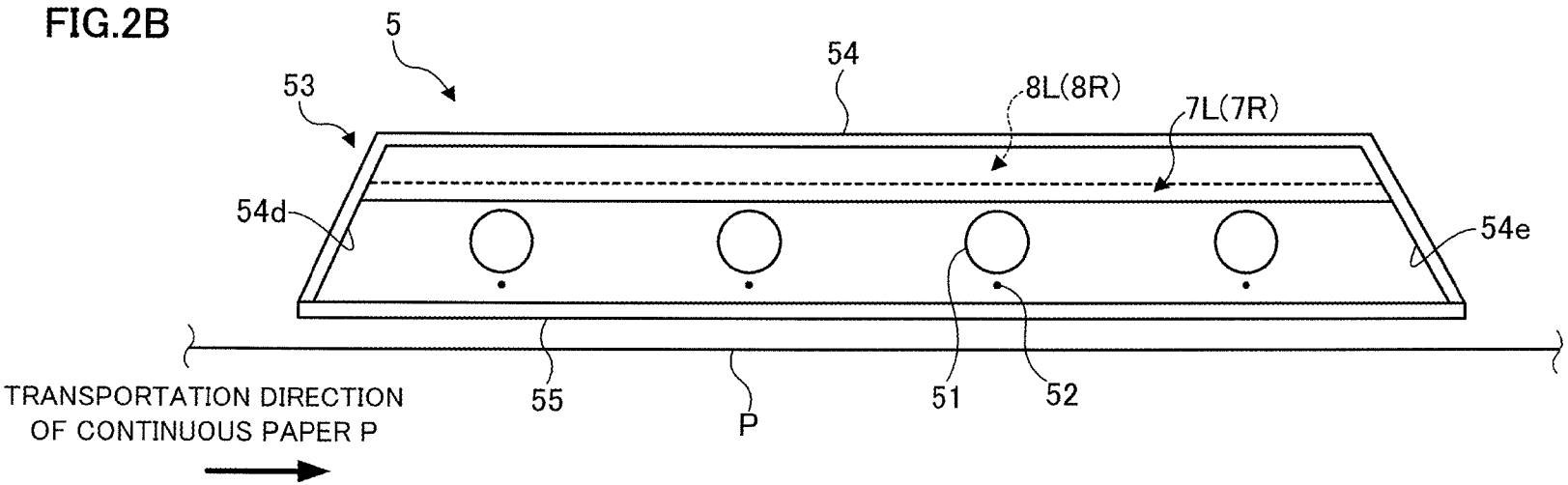
FIG. 2B shows a side view of the flash fixing apparatus viewing from a direction orthogonal to the transportation direction of the continuous paper.

Next, referring to FIG. 2, the overall configuration of the flash fixing apparatus 5 will be described. FIG. 2A shows a side view of the flash fixing apparatus 5 viewing from the upstream side in a transportation direction of the continuous paper P. FIG. 2B shows a side view of the flash fixing apparatus 5 viewing from a direction orthogonal to the transportation direction of the continuous paper P.

As shown in FIG. 2A, the flash fixing apparatus 5 applied with the first exemplary embodiment includes a flash lamp 51, a trigger wire 52, a reflection mechanism 53 that functions as a reflection member, and a cover glass 55.

In the first exemplary embodiment, the flash fixing apparatus 5 includes four flash lamps 51. The flash lamp 51 is a sealed transparent tube, for example, a glass tube or a silica tube in which a rare gas such as Xe (xenon gas) is sealed. Then, the flash lamp 51 irradiates the continuous paper P (toner image) with flash light while the flash lamp 51 repeats flashing in a predetermined cycle. Moreover, the flash lamp 51 has a linear shape extending in one direction. Further, each flash lamp 51 is installed in a direction that the axis center direction of the flash lamp 51 substantially intersects the transportation direction of the continuous paper P (intersect at 80 degrees to 100 degrees).

The trigger wire 52 is a conductive linear member such as tungsten steel or carbon (or SUS or Ni-Wire). This trigger wire 52 is located below each flash lamp 51. The trigger wire 52 is disposed along the axis center direction of the flash lamp 51. It should be noted that the trigger wire 52 is held on the flash lamp 51 by a suspension member (not shown).

The reflection mechanism 53 includes a chassis 54, flap reflection portions 7L and 7R, and V-shaped reflection portions 8L and 8R.

The chassis 54 that functions as a fixed reflection member is formed by five plate members, and has a box shape open to the transportation surface of the continuous paper P. The four flash lamps 51 are contained in the chassis 54. Inside the chassis 54, reflection surfaces 54*a*, 54*d* and 54*e* are configured by the five plate members. The reflection surfaces 54*a*, 54*d* and 54*e* are subjected to mirror processing that reflects the flash light. Among these reflection surfaces, the reflection surface 54*a* is located above the flash lamp 51, and is provided so as to be substantially parallel to the transportation surface of the continuous paper P. Moreover, in the respective reflection surfaces 54*d* and 54*e*, one end side brings into contact with the reflection face 54*a* and another end side extends in a direction apart from the flash lamp 51 when headed toward the continuous paper P.

Then, the flap reflection portions 7L and 7R, and the V-shaped reflection portions 8L and 8R that function as movable reflection members are attached on the reflection surface 54*a* side of the chassis 54. As shown in FIG. 2A, when viewing the flash fixing apparatus 5 from the upstream side in a transportation direction of the continuous paper P, the flap reflection portion 7L is disposed above the end portion side on the left of FIG. 2A of the flash lamp 51. On the other hand, the flap reflection portion 7R is provided above the end portion side on the right of FIG. 2A of the flash lamp 51. Further, the V-shaped reflection portions 8L and 8R are located above the flash lamp 51. The V-shaped reflection portions 8L and 8R are provided between the flap reflection portion 7L and the flap reflection portion 7R according to the order of the V-shaped reflection portion 8L and the V-shaped reflection portion 8R from the left side in FIG. 2A.

It should be noted that in the first exemplary embodiment, the flap reflection portion 7L and the V-shaped reflection portion 8L function as a first movable member. Further, the flap reflection portion 7R and the V-shaped reflection portion 8R function as a second movable member.

As the cover glass 55, it is used a flat plate such as the silica glass through which the flash light irradiated from the flash lamp 51 passes. Then, the cover glass 55 is located below the four flash lamps 51. The cover glass 55 is attached to the bottom end side of the chassis 54. The outer periphery of the cover glass 55 is fixed on the chassis 54, and thus the cover glass 55 is held on the chassis 54.

Next, referring to FIGS. 3 and 4, the flap reflection portions 7L and 7R, and the V-shaped reflection portions 8L and 8R will be described in detail. First, the flap reflection portions 7L and 7R will be described.

It should be noted that the flap reflection portion 7L has the same basic configuration as the flap reflection portion 7R. The flap reflection portions 7L and 7R have axial symmetry with respect to the center of the flash fixing apparatus 5 that serves as a symmetry axis when viewing the flash fixing apparatus 5 from the transportation direction of the continuous paper P. Accordingly, the flap reflection portion 7L will be described below as a representative example.

Figure 3A:
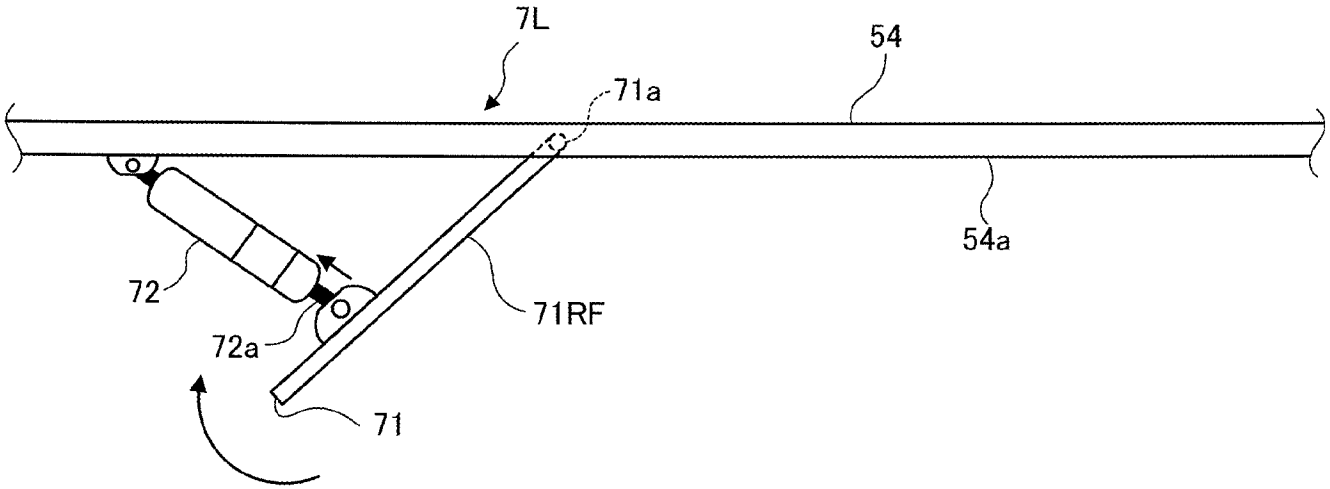
FIGS. 3A and 3B are diagrams that illustrate the flap reflection portion.
Figure 3B:
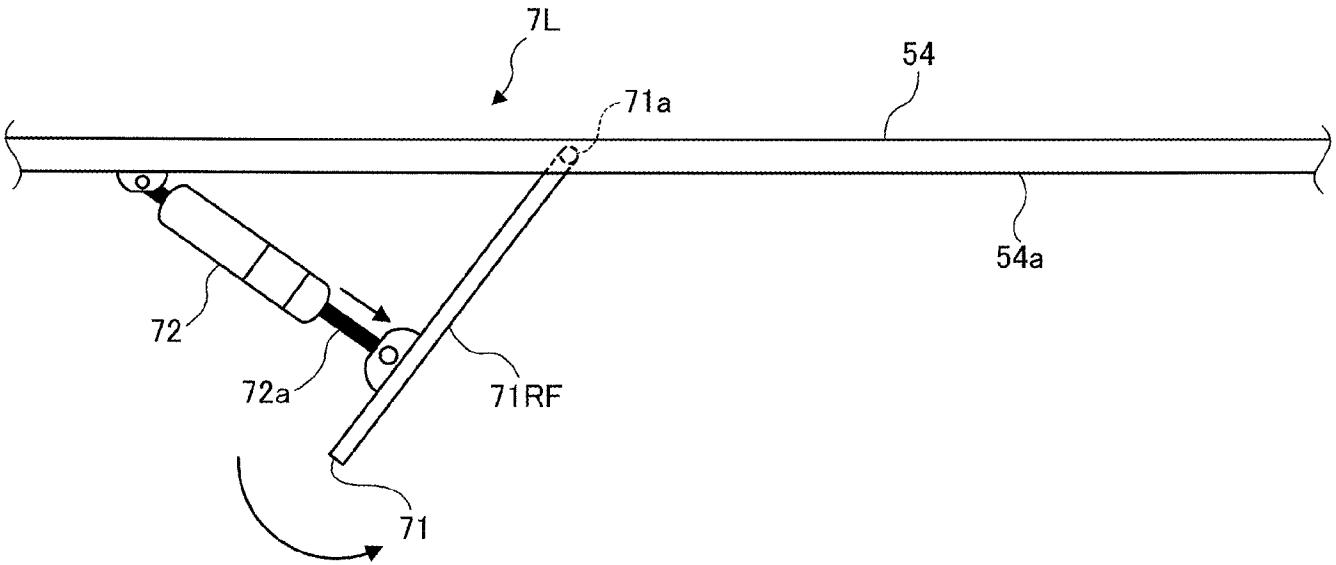

FIGS. 3A and 3B are diagrams that illustrate the flap reflection portion 7L. As shown in FIG. 3A, the flap reflection portion 7L includes a flap plate 71 and a flap drive unit 72. The flap plate 71 is a plate member with a vertically long shape. The flap plate 71 is provided in a direction substantially orthogonal to the axis center direction of the flash lamp 51. The flap plate 71 is attached on the reflection surface 54*a* side of the chassis 54 extending over an area above the four flash lamps 51 (refer to FIGS. 2A and 2B).

Then, an axis 71*a* is provided at one end portion on the long side of the flap plate 71. The flap plate 71 is held on the chassis 54 via the axis 71*a*. Thus, the flap plate 71 may freely rotate so that the axis 71*a* serves as a rotation axis.

Moreover, the flat plate 71 includes a flap reflection surface 71RF. The flap reflection surface 71RF is subjected to mirror processing that reflects the flash light. The flap reflection surface 71RF is provided so as to be opposed to one end portion of the flash lamp 51 that is located on the side away from the flap plate 71.

Further, to the flap plate 71, the flap drive unit 72 is attached. As the flap drive unit 72, an air cylinder (an actuator), a winch or the like is used. Then, one end side of the flap drive unit 72 is attached on the reflection surface 54*a* side of the chassis 54 and the other end side of the flap drive unit 72 is attached on the back side of the flap reflection surface 71RF of the flap plate 71, respectively. The flap drive unit 72 includes a moving rod 72*a*. Thus, by moving the rod 72*a*, the flap drive unit 72 itself is extended and shortened.

Then, while referring to FIGS. 3A and 3B, a movement of the flap reflection surface 71RF will be described.

First, when the flap drive unit 72 is shortened, the flap plate 71 swings (swings and moves) clockwise in FIG. 3A so that the axis 71*a* serves as a rotation axis. This causes the free end of the flap plate 71 to be moved to the reflection surface 54*a*. As a result of this, an inclination (angle) of the flap reflection surface 71RF to the reflection surface 54*a* is decreased. The state of the flap reflection surface 71RF moves close to a so-called lying state (a horizontal direction in FIG. 3A) (refer to FIG. 3A). On the other hand, when the flap drive unit 72 is extended, the flap plate 71 swings counterclockwise in FIG. 3B so that the axis 71*a* serves as a rotation axis. The free end is moved away from the reflection surface 54*a*. As a result of this, the inclination of the flap reflection surface 71RF to the reflection surface 54*a* is increased. The state of the flap reflection surface 71RF moves close to a so-called sheer state (a perpendicular direction in FIG. 3B) (refer to FIG. 3B). In such a manner, in accordance with the extension and shortening of the flap drive unit 72, the angle of the flap reflection surface 71RF is changed.

It should be noted that, in the flap reflection portion 7R, the angle of the flap reflection surface is axisymmetrically changed with respect to the flap reflection portion 7L.

Next, the V-shaped reflection portions 8L and 8R will be described in detail.

It should be noted that the V-shaped reflection portion 8L has the same basic configuration as the V-shaped reflection portion 8R. The V-shaped reflection portions 8L and 8R have an axisymmetrical relation with respect to the center of the flash fixing apparatus 5 that serves as a symmetrical axis when the flash fixing apparatus 5 is viewed from the transportation direction of the continuous paper P. Accordingly, the V-shaped reflection portion 8L will be described below as a representative example.

Figure 4A:
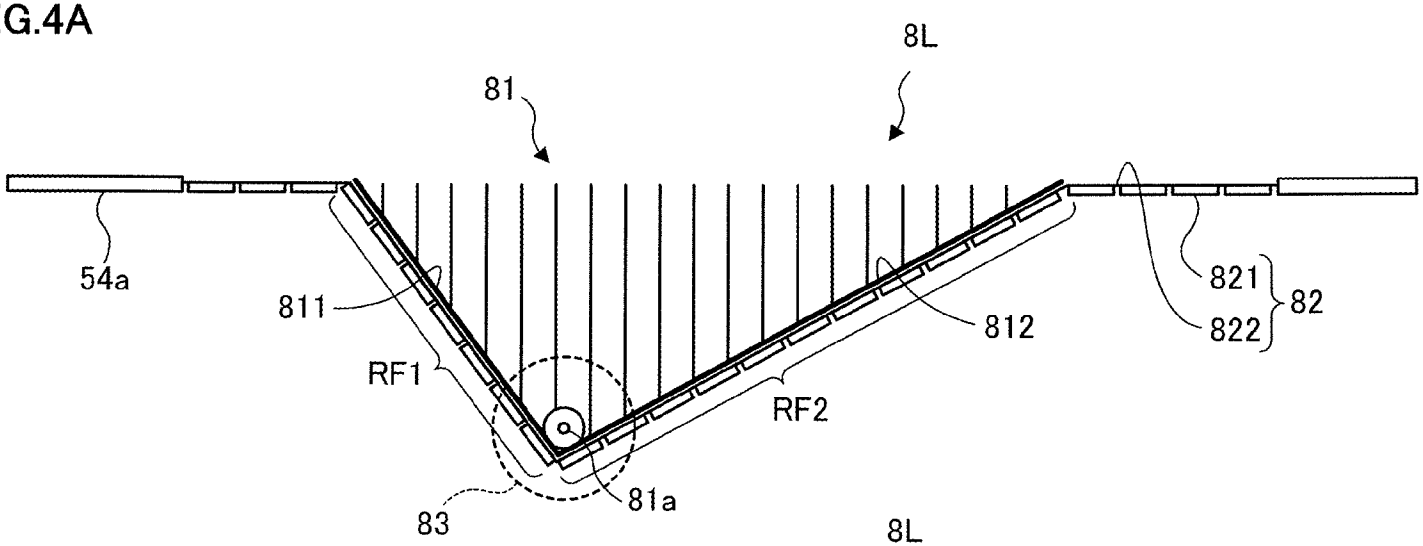
FIGS. 4A and 4B are diagrams that illustrate the V-shaped reflection portion.
Figure 4B:
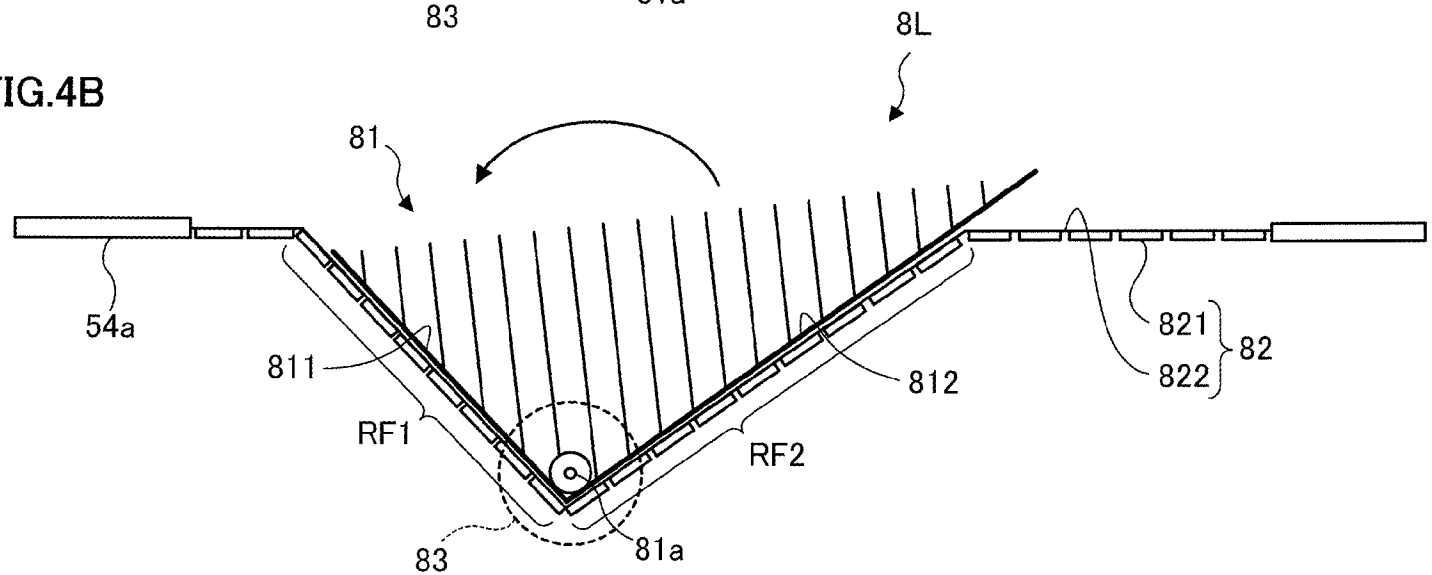

FIGS. 4A and 4B are diagrams that illustrate the V-shaped reflection portion 8L.

As shown in FIG. 4A, the V-shaped reflection portion 8L includes a rotator 81, a mirror sheet 82 and a rotator drive unit 83.

The rotator 81 is a vertically long member having a V-shaped cross section including a first surface 811 and a second surface 812. As the rotator 81, a member having high thermal conductivity such as an aluminum alloy is used. Moreover, inside the rotator 81, a cooling fin (not shown in the figure) is provided. The rotator 81 is arranged in a direction substantially orthogonal to the direction of the axis center of the flash lamp 51. The rotator 81 is arranged so as to extend over the area above the four flash lamps 51 (refer to FIG. 2B). Further, the first surface 811 is opposed to the left end side of the flash lamp 51 where an electrode 513L, which will be described later, is located, in FIG. 2A. On the other hand, the second surface 812 is opposed to the right end side of the flash lamp 51 where an electrode 513R, which will be described later, is located, in FIG. 2A. Thus, the rotator 81 is attached in a state where the rotator 81 protrudes toward the continuous paper P side on the reflection surface 54*a* side of the chassis 54. Further, on the tip end side of the protruded portion of the rotator 81, a rotary axis 81*a* is provided. This allows the rotator 81 to be rotated about the rotary axis 81*a*.

The mirror sheet 82 includes a film sheet 821 and plural mirrors 822. The film sheet 821 is a sheet member made of a heat resistant resin such as PET (polyethylene terephthalate). On the other hand, the mirror 822 is an elongated plate-shaped member subjected to reflection processing that reflects the flash light. Then, the plural mirrors 822 are tightly arranged on the film sheet 821 and fixed in a substantially orthogonal state to the axis center direction of the flash lamp 51.

The mirror sheet 82 is attached on the reflection surface 54*a* side of the chassis 54 with the tension applied so that the plural mirrors 822 is opposed to the flash lamp 51. Further, the mirror sheet 82 is pushed into toward the continuous paper P side from the upside by the above-described rotator 81. At this time, the mirror sheet 82 is installed along two surfaces which are the first surface 811 and the second surface 812, included the rotator 81. It should be noted that, hereinafter, the surface of the mirror sheet 82 along the first surface 811 of the rotator 81 is designated as a first reflection surface RF1. On the other hand, the surface of the mirror sheet 82 along the second surface 812 of the rotator 81 is designated as a second reflection surface RF2. As the rotator drive unit 83, a motor or the like is used. The rotator drive unit 83 is connected to the rotary axis 81*a*. Then, by driving the motor and rotating the rotary axis 81*a*, the rotator 81 rotates at an arbitrary angle.

Next, a movement of the first reflection surface RF1 and the second reflection surface RF2 will be described.

First, when the rotator drive unit 83 is driven in a clockwise direction in FIG. 4A, the rotator 81 is rotated clockwise in FIG. 4A about the rotary axis 81*a*. Then, the inclination of the first reflection surface RF1 to the reflection surface 54*a* is increased. The state of the first reflection surface RF1 moves close to a so-called sheer state. On the other hand, the inclination of the second reflection surface RF2 to the reflection surface 54*a* is decreased. The state of the second reflection surface RF2 moves close to a so-called lying state.

Moreover, when the rotator drive unit 83 is driven in a counterclockwise direction in FIG. 4A, the rotator 81 is rotated counterclockwise in FIG. 4A about the rotary axis 81*a* (refer to FIG. 4B). At this time, the inclination of the first reflection surface RF1 to the reflection surface 54*a* is decreased. The state of the first reflection surface RF1 moves close to a so-called lying state. Then, the inclination of the second reflection surface RF2 to the reflection surface 54*a* is increased. The state of the second reflection surface RF2 moves close to a so-called sheer state. In such a manner, in accordance with the rotation of the rotator 81, the angles of the first reflection surface RF1 and the second reflection surface RF2 are changed.

Note that in the V-shaped reflection portion 8R, an angle is changed axisymmetrically with respect to the first reflection surface and the second reflection surface in the V-shaped reflection portion 8L.

It should be noted that, in the first exemplary embodiment, the first reflection surface RF1 provided on the V-shaped reflection portion 8L functions as a first reflection surface. The second reflection surface RF2 provided on the V-shaped reflection portion 8L and the flap reflection surface 71RF provided on the flap reflection portion 7L function as a second reflection surface.

The second reflection surface provided on the V-shaped reflection portion 8R and the flap reflection surface provided on the flap reflection portion 7R function as a third reflection surface. The first reflection surface provided on the V-shaped reflection portion 8R functions as a fourth reflection surface.

Next, electrical connection in the flash fixing apparatus 5 will be described.

As shown in FIG. 2A, the flash lamp 51 further includes the electrodes 513L and 513R, and conductors 515L and 515R. The electrodes 513L and 513R are located inside the flash lamp 51, and are provided on both end sides in the longitudinal direction of the flash lamp 51. The conductors 515L and 515R are attached so as to respectively pass through the both end sides in the longitudinal direction of the flash lamp 51. One end of the conductor 515L is connected to the electrode 513L provided inside the flash lamp 51. One end of the conductor 515R is similarly connected to the electrode 513R provided inside the flash lamp 51. On the other hand, the other end of the conductor 515L and the other end of the conductor 515R that are exposed outside the flash lamp 51 are connected to a power circuit (not shown in the figure), respectively. This power circuit supplies electric power to the electrodes 513L and 513R via the conductors 515L and 515R.

One end side of the trigger wire 52 is connected to a trigger cable 521. Further, the trigger cable 521 is connected to the power circuit (not shown in the figure) similarly to the conductors 515L and 515R connected to the flash lamp 51. The electric power is supplied to the trigger cable 521 at predetermined timing.

As described above, the cover glass 55 is attached to an aperture of the chassis 54 so as to cover the aperture. Thereby, the inside of the flash fixing apparatus 5 becomes a substantially close space. This suppresses invasion of unfixed toner formed on the continuous paper P, dust or the like to the inside of the chassis 54 and adhesion of them to the flash lamp 51. In addition, the flash fixing apparatus 5 is equipped with a cooling mechanism such as a cooling fan (not shown in the figure).

The flash fixing apparatus 5 configured in such a manner keeps a predetermined distance to the continuous paper P, and is arranged so as not to be brought into contact with the continuous paper P. Moreover, the flash fixing apparatus 5 is set so as to have a slightly larger dimension than the length of the continuous paper P in a direction orthogonal to the transportation direction of the continuous paper P (hereinafter, referred to as the width of the continuous paper P).

Next, the fixing controller 41 will be described.

Figure 5:
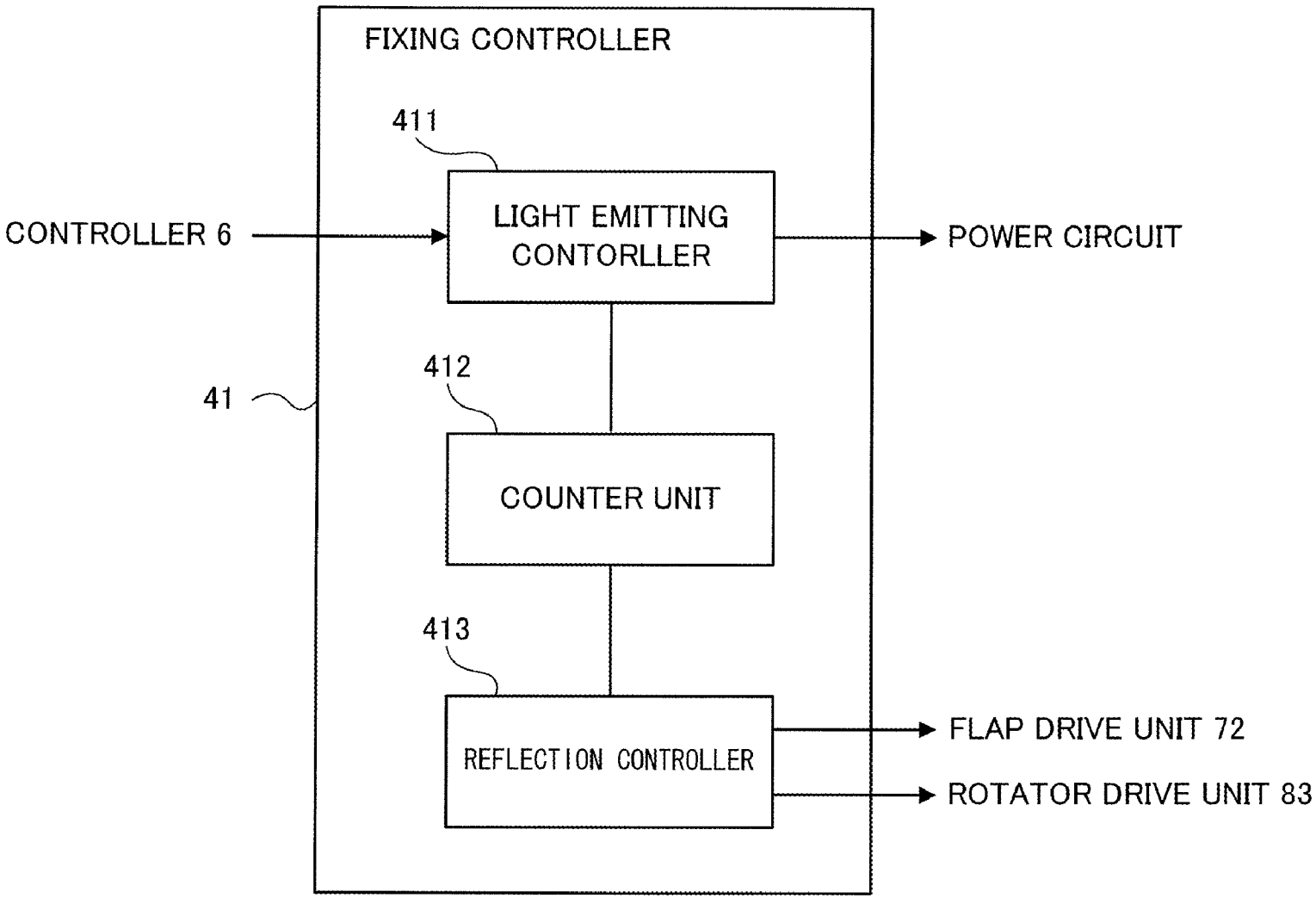
FIG. 5 is a block diagram that illustrates a configuration of the fixing controller.

FIG. 5 is a block diagram that illustrates a configuration of the fixing controller 41.

The fixing controller 41 includes a light emitting controller 411, a counter unit 412 that functions as a counter unit, and a reflection controller 413 that functions as an instruction unit.

The light emitting controller 411 receives an instruction of fixing, from the controller 6, and sends an instruction to provide a condition of predetermined flash light emitting to the power circuit of the flash lamp 51 and the trigger wire 52. The instruction sent by the light emitting controller 411 to the power circuit is mainly a voltage value to be applied to the flash lamp 51, a light emitting frequency value and the like. Further, the light emitting controller 411 refers to a cumulative light emitting frequency of the flash lamp 51 stored in the counter unit 412, and sends a voltage value set in response to the cumulative light emitting frequency of the flash lamp 51, to the electric power circuit.

The counter unit 412 acquires the number of emission of the flash lamp 51 from the light emitting controller 411. The counter unit 412 computes the cumulative number of emission until the time point of the present light emitting while counting (measuring) the number of emission for every light emitting of the flash lamp 51. Note that the cumulative number of emission is reset to zero when the flash lamp 51 is attached to the flash fixing apparatus 5. The reflection controller 413 refers to the cumulative number of emission of the flash lamp 51 that is stored in the counter unit 412, and sends an instruction for driving, to the flap drive unit 72 and the rotator drive unit 83.

Next, fixing operation by the flash fixing apparatus 5 will be described. When the continuous paper P on which a toner image is formed passes under the flash fixing apparatus 5, voltage is applied to the trigger wire 52 from the power circuit (not shown in the figure) through the trigger cable 521. Then, the trigger wire 52 triggers a dielectric breakdown by a xenon gas sealed inside the flash lamp 51. In synchronism with this timing, voltage is applied between the electrodes 513L and 513R by the power circuit (not shown in the figure) through the conductors 515L and 515R. This results in the flow of an electric current between the electrodes 513L and 513R through the xenon gas which causes the dielectric breakdown. Then, the xenon gas in the tube of the flash lamp 51 becomes in an excited state, and the flash light is emitted from the flash lamp 51. The flash lamp 51 irradiates the continuous paper P (a toner image) with the flash light at a predetermined cycle.

Then, the flash light emitted from the flash lamp 51 is transmitted by the cover glass 55, and irradiates the toner image formed on the continuous paper P. Among the flash light emitted from the flash lamp 51, a flash light which does not directly proceed to the continuous paper P reflects on the reflection surface included in the reflection mechanism 53, thereby indirectly irradiating the continuous paper P. Then, as optical energy, the flash light irradiated from the flash lamp 51 is absorbed into the toner image. In the toner image absorbing the optical energy, toner is heated and melted. Thus, the toner image is fixed on the continuous paper P. In this way, the flash fixing apparatus 5 executes fixing of the toner image without contact with the continuous paper P.

In the flash fixing apparatus 5 to which the first exemplary embodiment is applied, the inclinations of the reflection surface provided on the flap reflection portions 7L and 7R, and the inclinations of the V-shaped reflection portions 8L and 8R are changed respectively in response to the cumulative number of emission of the flash lamp 51. Therefore, a state of the flash lamp 51 is classified into three states corresponding to the cumulative number of emission of the flash lamp 51, as described below.

A start point for the number of emission is set when the flash lamp 51 is attached (the number of emission is zero). An end point for the number of emission is set when the flash lamp 51 reaches a recommended time in replacement. Further, between the start and the end points, a first count value and a second count value are set based on an arbitrary number of emission. It is determined that a first stage is the period between the time point when the flash lamp 51 is attached and the first count value, a middle stage is the period between the first count value and the second count value, and a last stage is the period between the second count value and the number of emission when the flash lamp 51 reaches the recommended time for replacement.

In the first exemplary embodiment, the recommended time for replacement of the flash lamp 51 is at the time when the number of emission reaches 15 millions. Further, the first count value is set as 3 millions, and the second count value is set as 7.5 millions. Accordingly, in the first stage, the range of the number of emission of the flash lamp 51 is zero (0) to 3 millions. In the middle stage, the range of the number of emission of the flash lamp 51 is 3 to 7.5 millions. In the last stage, the range of the number of emission of the flash lamp 51 is 7.5 to 15 millions.

Then, a change in inclination of the flap reflection surface 71RF, the first reflection surface RF1 and the second reflection surface RF2 (hereinafter, referred to as a movable reflection surface) in response to a change in cumulative number of emission of the flash lamp 51 according to the first, the middle and the last stages will be described. Further, at this time, the light path of the flash light reflected on the movable reflection surface will also be described together. It should be noted that the description of the movable reflection surface is represented by the flap reflection portion 7L and the V-shaped reflection portion 8L.

Figures 6A, 6B, 6C:
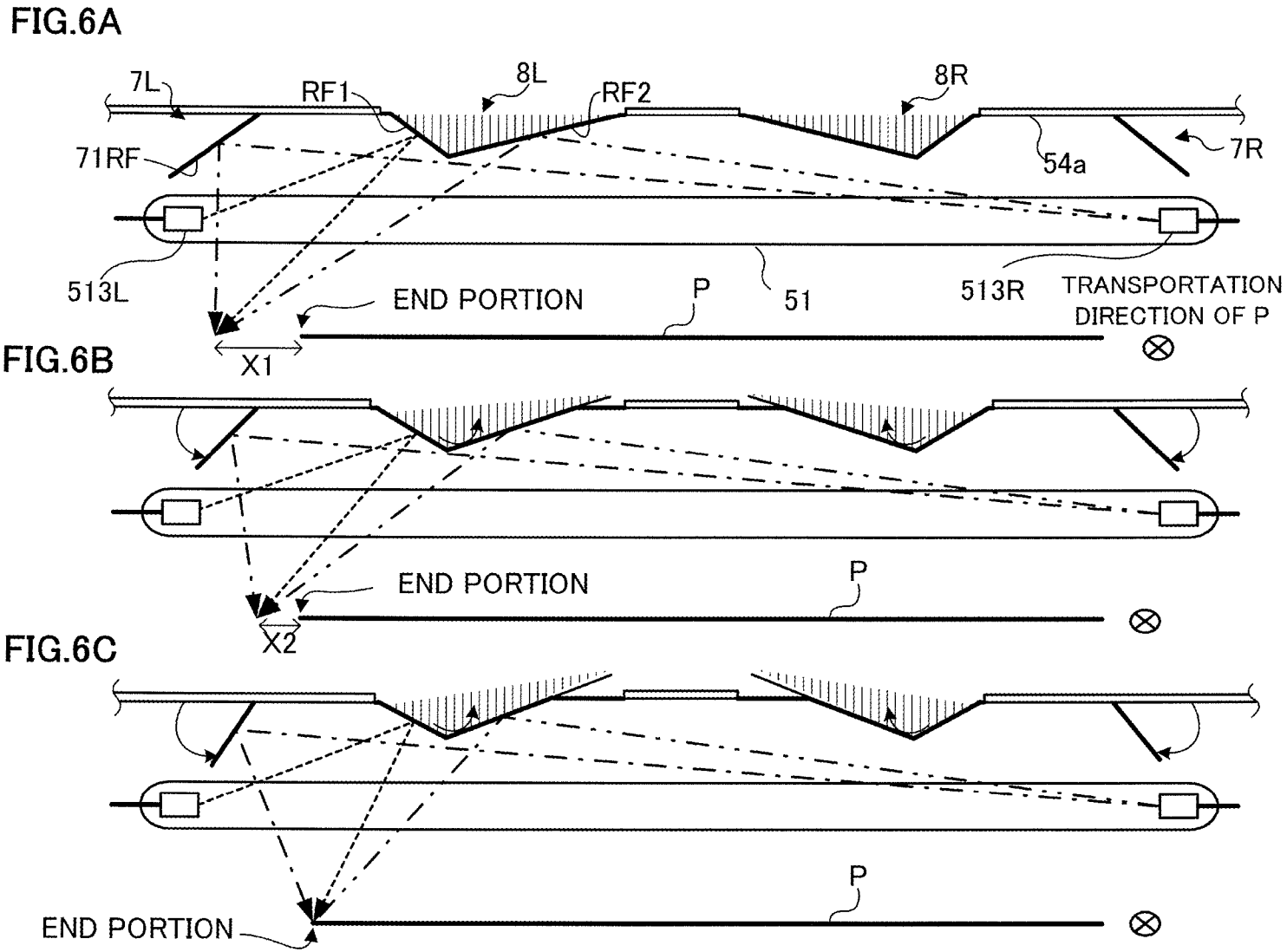
FIG. 6A illustrates the flash fixing apparatus in the case when the flash lamp is in the first stage.
FIG. 6B illustrates the flash fixing apparatus in the case when the flash lamp is in the middle stage.
FIG. 6C illustrates the flash fixing apparatus in the case when the flash lamp is in the last stage.

FIG. 6A illustrates the flash fixing apparatus 5 in the case when the flash lamp 51 is in the first stage. FIG. 6B illustrates the flash fixing apparatus 5 in the case when the flash lamp 51 is in the middle stage. FIG. 6C illustrates the flash fixing apparatus 5 in the case when the flash lamp 51 is in the last stage.

In FIGS. 6A to 6C, the arrow line of dashed-dotted lines in FIGS. 6A to 6C indicates the light path of the flash light from the center of the electrode 513R to the flap reflection surface 71RF (hereinafter, referred to as light path 1). The arrow line of dashed-two dotted lines in FIGS. 6A to 6C indicates the light path of the flash light from the center of the electrode 513R to the second reflection surface RF2 (hereinafter, referred to as light path 2). Further, broken lines in FIGS. 6A to 6C indicate the light path of the flash light from the center of the electrode 513L to the first reflection surface RF1 (hereinafter, referred to as light path 3). It should be noted that each light path is reflected on a center of each movable reflection surface when the reflection surface is divided in half in a longitudinal direction.

First, as shown in FIG. 6A, when the flash lamp 51 is in the first stage, each movable reflection surface is set at an inclination so as to make an illuminance distribution provided by the flash lamp 51 in the first stage uniform as a whole (hereinafter, referred to as a state A). Then, the flash light irradiated from the center of the respective electrodes 513L and 513R reaches outside of the left side end portion (hereinafter, referred to as left end portion) when viewing from the upstream side in the transportation direction of the continuous paper P with respect to the width direction of the continuous paper P through the light paths 1, 2 and 3. Note that a distance between the left end portion and the arrival point of each light path is designated as a distance X1.

Further, as the cumulative number of emission of the flash lamp 51 is increased, the flash lamp 51 moves from the first stage to the middle stage. At this time, the cumulative number of emission of the flash lamp 51 reaches the first count value. Then, the movable reflection surface is changed at a inclination so as to make an illuminance distribution provided by the flash lamp 51 in the middle stage uniform as a whole (hereinafter, referred to as the state B). The flap drive unit 72 receiving an instruction from the reflection controller 413 extends and swings the flap reflection surface 71RF in counterclockwise direction in FIG. 6B (refer to FIG. 6B). At this time, the flap reflection surface 71RF is changed into a sheer state as compared with the state A. Further, similarly, the rotator drive unit 83 receiving an instruction from the reflection controller 413 rotates the rotator 81 in counterclockwise direction in FIG. 6B. At this time, the first reflection surface RF1 is changed into a lying state as compared with the state A. On the other hand, the second reflection surface RF2 is changed into a sheer state as compared with the state B. At this time, the flash light irradiated from around respective electrodes 513L and 513R reaches a point closer to the left end portion of the continuous paper P than the distance X1 through the light paths 1, 2 and 3. Note that a distance from the left end portion of this point is designated as a distance X2.

Then, the cumulative number of emission of the flash lamp 51 is further increased and reaches the second count value. That is, the flash lamp 51 moves to the last stage. The movable reflection surface at this time is set at an inclination so as to make an illuminance distribution provided by the flash lamp 51 in the last stage uniform (hereinafter, referred to as a state C). The flap drive unit 72 receiving an instruction from the reflection controller 413 further extends and moves the flap reflection surface 71RF in counterclockwise direction in FIG. 6C (refer to FIG. 6C). At this time, the flap reflection surface 71RF is changed into a further sheer state as compared with the state B. Similarly, the first reflection surface RF1 is changed into a further lying state. The second reflection surface RF2 is also changed into a further sheer state. At this time, the flash light irradiated from the center of the respective electrodes 513L and 513R reaches the left end portion of the continuous paper P through the light paths 1, 2 and 3.

As described above, the flap reflection portion 7L and the V-shaped reflection portion 8L are changed such that the arrival point of the flash light reflected on the reflection surface is gradually close from a position apart from the left end portion of the continuous paper P to the left end portion of the continuous paper P following an increase in cumulative number of emission of the flash lamp 51.

A movement of the flap reflection portion 7R and the V-shaped reflection portion 8R is also similar to that of the above-mentioned flap reflection portion 7L and the V-shaped reflection portion 8L. The flap reflection portion 7R and the V-shaped reflection portion 8R are changed such that the arrival point of the flash light reflected on the reflection surface is gradually close from a position apart from the right end portion of the continuous paper P to the right end portion of the continuous paper P following an increase in cumulative number of emission of the flash lamp 51.

From the above, among movable reflection surfaces, a movable reflection surface opposed to the electrodes 513L or 513R on the side near to a position where the movable reflection surface is attached changes the inclination of the reflection surface so as to become horizontal in FIGS. 6A to 6C following an increase in cumulative number of emission. On the other hand, among movable reflection surfaces, a movable reflection surface opposed to the electrodes 513L or 513R on the far side of the movable reflection surface changes the inclination of the reflection surface so as to become perpendicular in FIGS. 6A to 6C following an increase in cumulative number of emission.

Note that when the cumulative number of emission is further increased and the flash lamp 51 reaches a recommended time in replacement, the flash lamp 51 will be replaced and a new flash lamp 51 will be attached. In this case, the movable reflection surface is set so as to repeatedly return to the state A.

Next, a change in flash light quantity of the flash fixing apparatus 5 in response to a change in number of emission of the flash lamp 51 will be described.

Figures 7A, 7B:
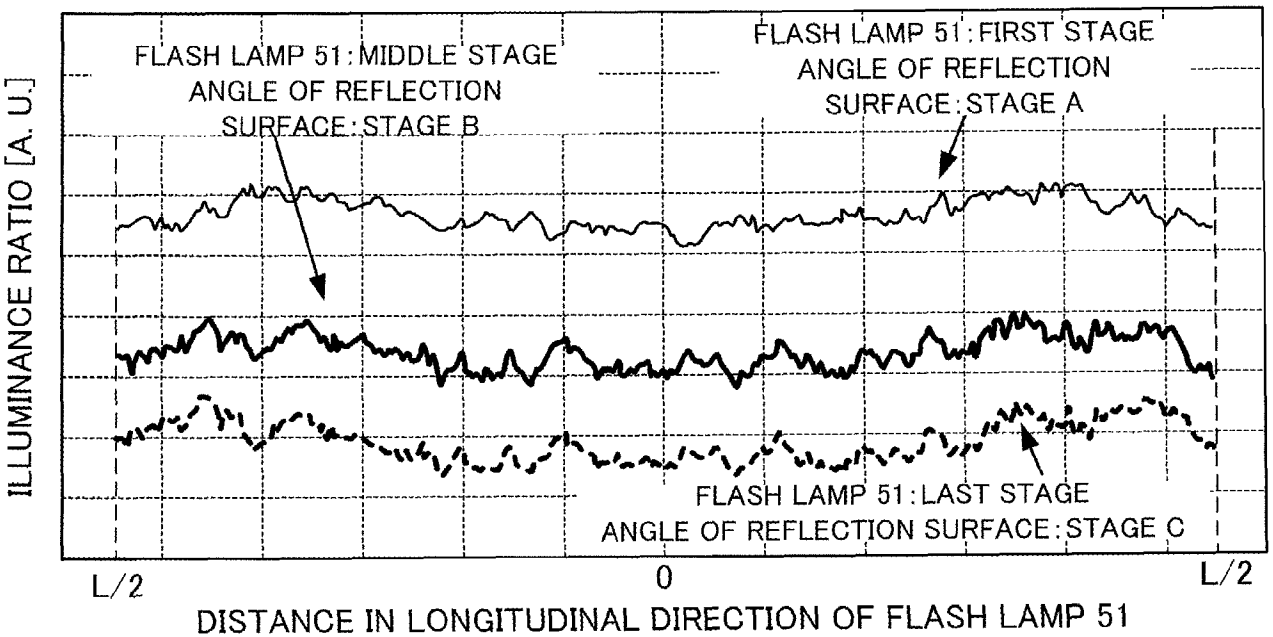
FIG. 7A is a graph that illustrates the distribution of illuminance (hereinafter, referred to as illuminance distribution) taking the longitudinal direction of the flash lamp as a reference, with respect to light quantity (hereinafter, referred to as illuminance) that is received by each continuous paper from the flash fixing apparatus.
FIG. 7B is a table that illustrates the amount of an average value or the like of illuminance provided by the flash fixing apparatus shown in FIG. 7A.

FIG. 7A is a graph that illustrates the distribution of illuminance (hereinafter, referred to as illuminance distribution) taking the longitudinal direction of the flash lamp 51 as a reference, with respect to light quantity (hereinafter, referred to as illuminance) that is received by each continuous paper P from the flash fixing apparatus 5. It should be noted that in FIG. 7A, the illuminance distribution when the flash lamp 51 is in the first, the middle and the last stages is shown respectively. FIG. 7B is a table that illustrates the amount of an average value or the like of illuminance provided by the flash fixing apparatus 5 shown in FIG. 7A.

Note that an abscissa axis in FIG. 7A indicates a distance in the longitudinal direction of the flash lamp 51. Further, on the graph, a distance in the longitudinal direction of the flash lamp 51 is designated as a distance L. The center of the flash lamp 51 in the longitudinal direction is designated as an origin (0). Thus, respective both the end portions of the flash lamp 51 are provided as L/2 from the origin. On the other hand, the ordinate axis of the graph represents an illuminance ratio. Note that the illuminance ratio described here is the illuminance measured for each measuring point divided by an arbitrary fixed value and is standardized. The illuminance ratio is represented by an arbitrary unit ([A.U.]). In addition, in the following description, the definition of an axis concerning a similar graph to FIG. 7A is the same as that described above.

As shown in FIG. 7A, as the number of emission of the flash lamp 51 is increased according to the transition from the first stage to the middle stage and from the middle stage to the last stages, the illuminance is decreased as a whole. Further, when attention is focused on the illuminance distribution, it is apparent that the illuminance at the center portion and on the end portion side is approximately equivalent in the first, the middle and the last stages respectively. Furthermore, as shown in FIG. 7B, in the illuminance distribution provided by each flash lamp 51, when a difference between the maximum and the minimum values (hereinafter, referred to as maximum minimum difference) of the illuminance is compared, it is provided as 0.011 in the first stage, 0.010 in the middle stage and 0.011 in the last stage. Accordingly, it is apparent that the maximum minimum difference is equivalent in three sates of the flash lamp 51. That is, if the flash lamp 51 moves from the first stage to the last stage, a change in maximum minimum difference is small. Therefore, it is apparent that each illuminance distribution is uniform as a whole.

Next, in a fixing apparatus in which the angle of a reflection surface is fixed, how an illuminance distribution is changed following an increase in cumulative number of emission of the flash lamp 51 will be described.

Figure 8A:
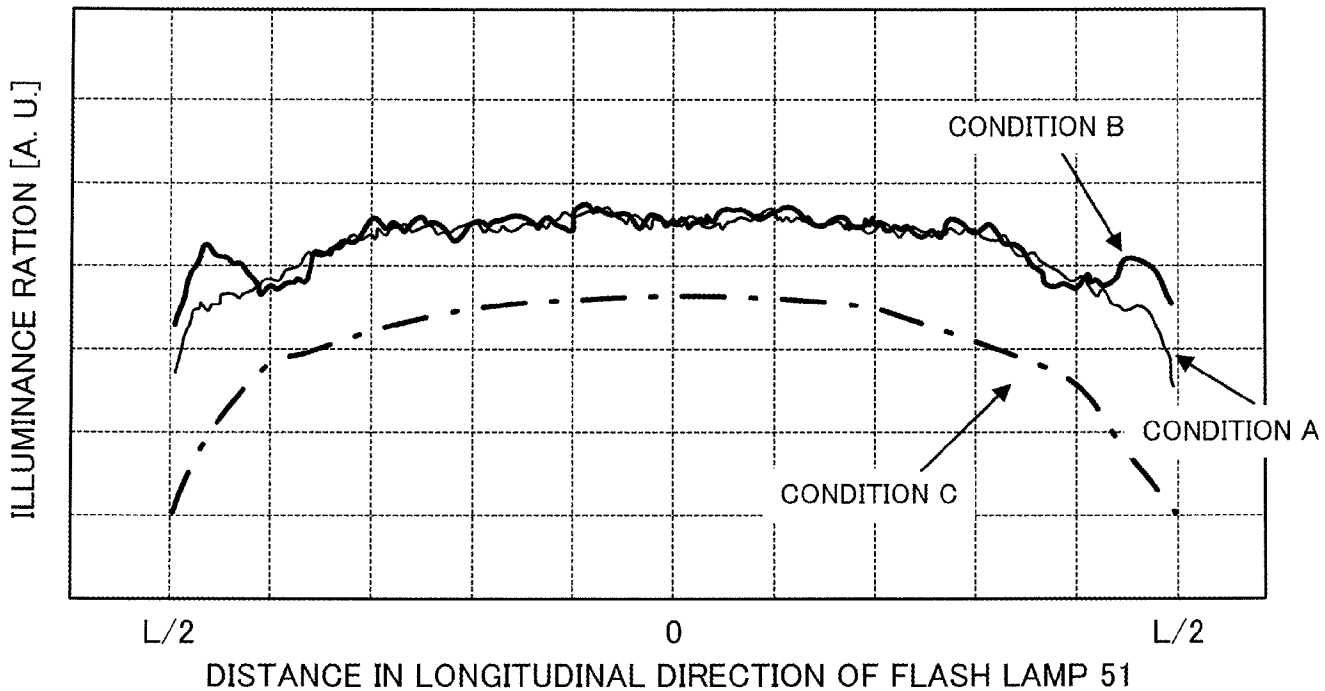
FIG. 8A is a graph that illustrates the illuminance distribution of a flash fixing apparatus fixing the angle of the reflection surface.
Figure 8B:
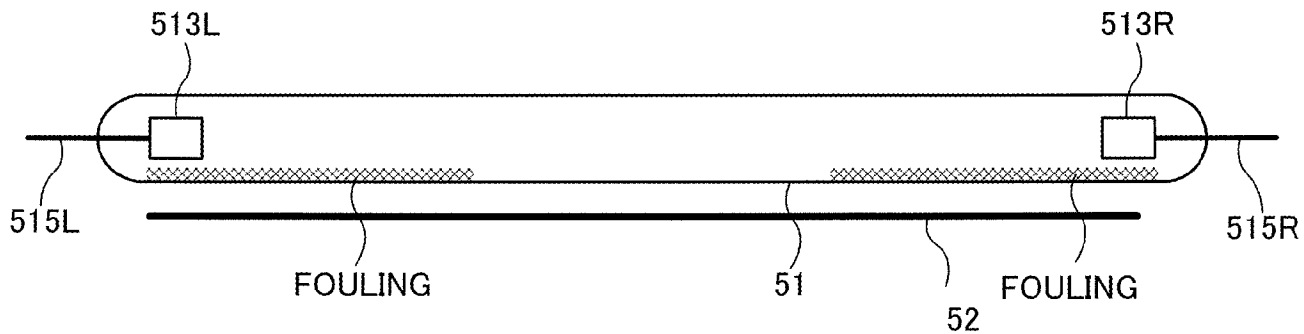
FIG. 8B is a diagram that illustrates fouling inside the tube of the flash lamp.

FIG. 8A is a graph that illustrates the illuminance distribution of a flash fixing apparatus fixing the angle of the reflection surface. FIG. 8B is a diagram that illustrates fouling inside the tube of the flash lamp 51.

For purposes of comparison, three conditions are given as follows.

In the condition (A), the flash lamp 51 in the first stage is used. However, in the condition (A), the above-described movable reflection surface is not included, and only reflection surfaces 54*a* to 54*e* provided on the chassis 54 are included.

Then, in the condition (B), the reflection mechanism 53 including the movable reflection surface set in the state A is applied to the flash lamp 51 in the first stage.

Further, in the condition (C), the reflection mechanism 53 including the movable reflection surface set in the state A is applied to the flash lamp 51 in the last stage. That is, a case where the inclination of the reflection surface set for the flash lamp 51 in the first stage remains and is unchanged afterward, the cumulative number of emission is increased, and the flash lamp 51 reaches the last stage is assumed.

First, the illuminance distribution in the conditions (A) and (B) will be compared. In the condition (A), the illuminance is increased around the center of the flash lamp 51 and decreased as a position approaches to the end portion side of the flash lamp 51. In contrast to this, in the condition (B), as compared with the condition (A), the maximum minimum difference of illuminance, that is, illuminance unevenness is decreased. Accordingly, an original characteristic of the flash lamp 51 is corrected by providing the flash fixing apparatus with the reflection mechanism 53. The original characteristic of the flash lamp 51 is the illuminance being gradually decreased from around the center toward the end portion side. As a result of this, in the flash fixing apparatus including the movable reflection surface set in the state A (the condition (B)), an illuminance distribution becomes uniform as a whole.

Next, the illuminance distribution in the conditions (B) and (C) will be compared. First, when the flash lamp 51 reaches the last stage, the illuminance is decreased as a whole. In particular, as compared with the first stage, the illuminance on the end portion side is more significantly decreased than that near the center. This is because the flash lamp 51 repeats flash light emission, and thereby adhering fouling inside the tube of the flash lamp 51. The cause is generation of so-called sputtering in which a rare gas in the tube of the flash lamp 51 collides with the electrodes 513L and 513R in the flash lamp 51 applied with voltage to deposit metal which forms the electrodes 513L and 513R. That is, during repetition of the flash light emitting, below the respective electrodes 513L and 513R, fouling is gradually deposited from the end portion side to the center portion. Thus, the illuminance of the end portion side is significantly decreased (refer to FIG. 8B).

From the above-described reason, it is apparent that, even when the inclination of the reflection surface set based on the flash lamp 51 in the first stage (in this case, the inclination of the movable reflection surface set in the state A) is applied to the flash lamp 51 in the last stage as it is, the illuminance on the end portion side is not sufficiently enhanced. Further, overall illuminance of the flash lamp 51 in the last stage may be enhanced by increasing voltage to be applied to the flash lamp 51. However, as the number of emission of the flash lamp 51 moves from the first stage to the last stage, a fouling extent is changed. Accordingly, from the above, it is indicated that, in order to make the illuminance in a longitudinal direction uniform during a period in use from the first stage to the last stage of the flash lamp 51, the inclination of the reflection surface needs to be changed.

Further, as a comparative example, a case where a movable reflection surface that is set in the state C is applied to the first stage flash lamp 51 will be described.

Figures 9A, 9B:
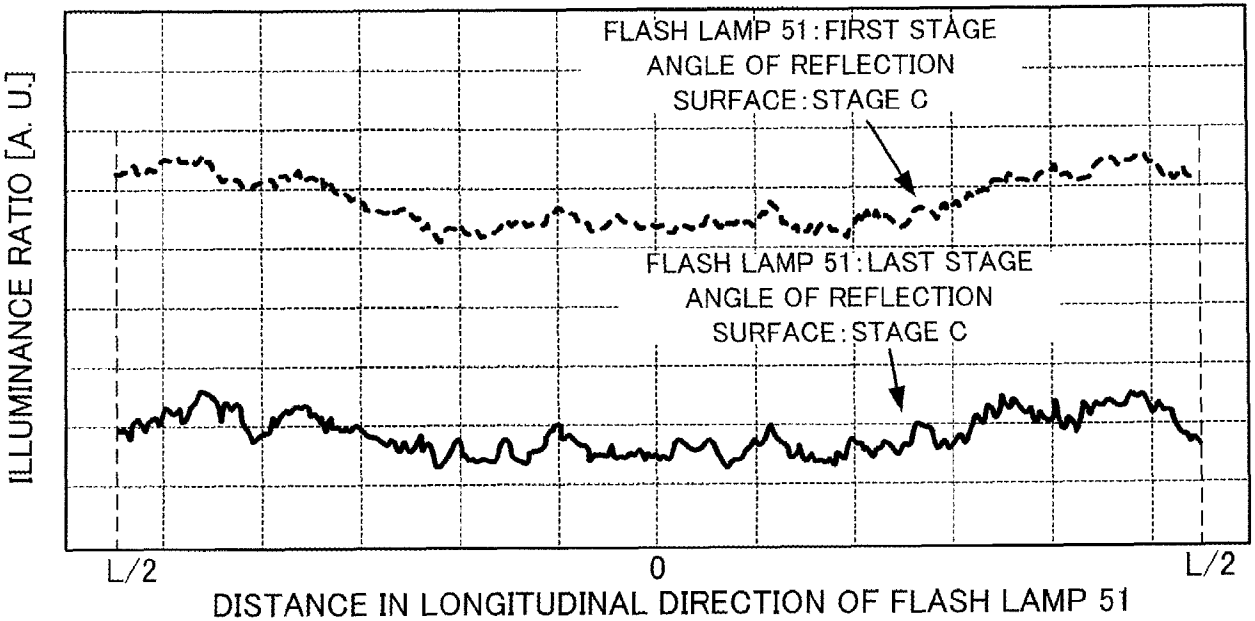
FIG. 9A illustrates the illuminance distribution when the movable reflection surface set in the state C is applied to the flash lamps in the first stage and in the last stage.
FIG. 9B illustrates the amount of an average value or the like in the illuminance distribution shown in FIG. 9A.

FIG. 9A illustrates the illuminance distribution when the movable reflection surface set in the state C is applied to the flash lamps 51 in the first stage and in the last stage. FIG. 9B illustrates the amount of an average value or the like in the illuminance distribution shown in FIG. 9A.

As shown in FIG. 9A, it is apparent that, if the movable reflection surface set in the state C is applied to the flash lamp 51 in the first stage, the illuminance on the end portion side is relatively higher than that around the center and the illuminance distribution become less uniform as a whole. Further, at this time, the maximum minimum difference is provided as 0.018. Thereby it is clarified that the maximum minimum difference is increased as compared with the case where the maximum minimum difference is 0.011 when the movable reflection surface set in the state C is applied to the flash lamp 51 in the last stage (refer to FIG. 9B). Thus, it is apparent that, when the movable reflection surface (in the state C) set so as to be made the illuminance distribution of the flash lamp 51 in the last stage uniform is applied to the flash lamp 51 in the first stage, the illuminance on the end portion side is higher than that around the center and the illuminance distribution become less uniform as a whole.

Next, the number of emission of the flash lamp 51 and the timing of the change of the inclination of the movable reflection surface will be described.

Figure 10:
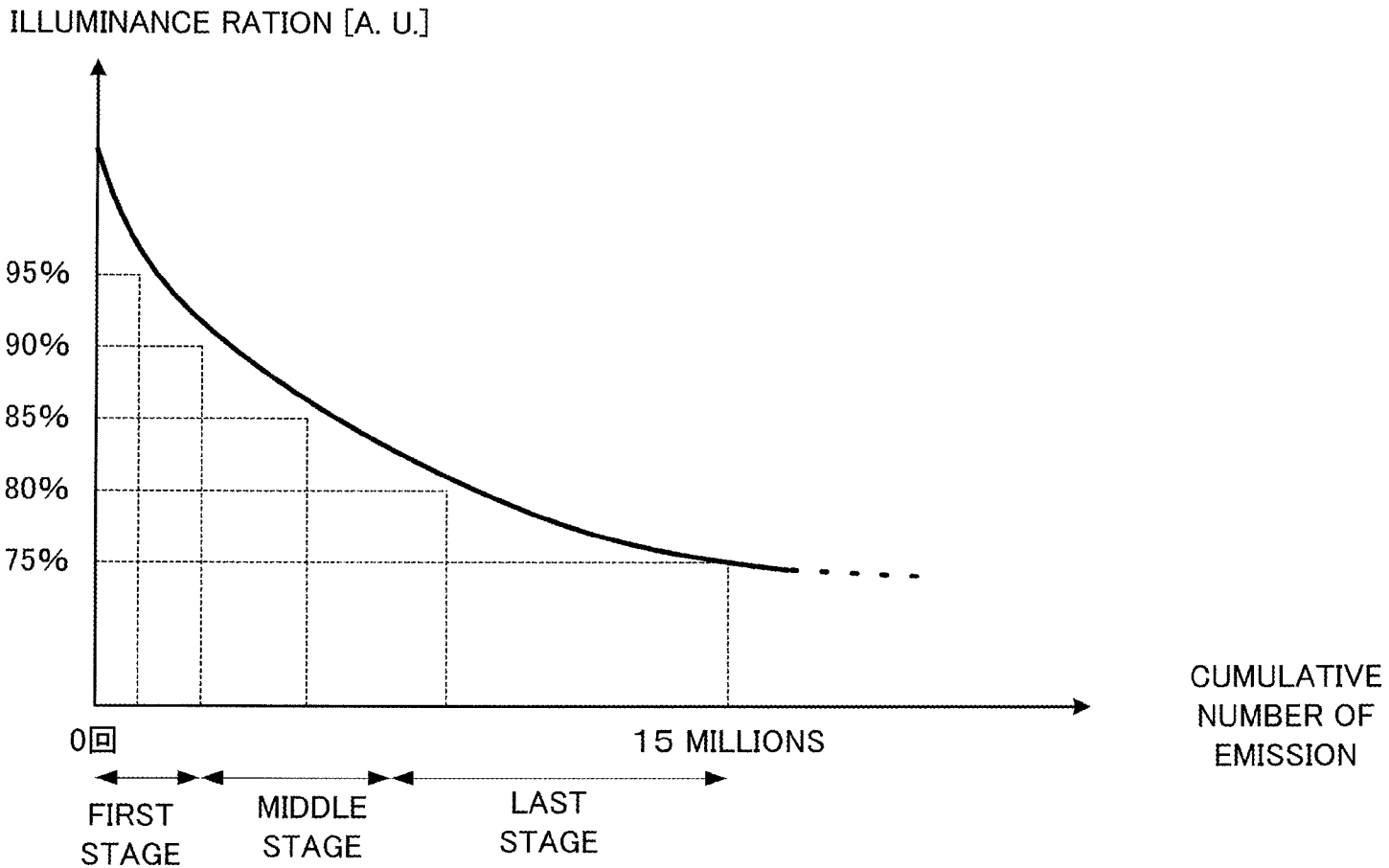
FIG. 10 is a diagram that illustrates a change in illuminance of the whole flash lamp associated with the number of emission of the flash lamp.

FIG. 10 is a diagram that illustrates a change in illuminance of the whole flash lamp 51 associated with the number of emission of the flash lamp 51.

As shown in FIG. 10, the illuminance of the flash lamp 51 is decreased as the number of emission is increased. Moreover, as a stage is close to the first stage, the amount of decrease in illuminance per the number of emission is great. Conversely, it is apparent that between the middle and the last stages, the amount of decrease in illuminance per number of emission is relatively small.

Thus, in a stage where the cumulative number of emission is small such as the case of the flash lamp 51 in the first stage, it is necessary to change the inclination of the movable reflection surface relatively frequently. On the other hand, after that, as a stage is close to the middle and the last stages, it is apparent that it is not necessary to change the inclination of the movable reflection surface frequently.

Accordingly, in the first exemplary embodiment, the first count value is set as 3 millions and the second count value is set as 7.5 millions with respect to 15 millions where the flash lamp 51 reaches a recommended time for replacement.

Second Exemplary Embodiment

Next, the second exemplary embodiment will be described. The basic configuration of the flash fixing apparatus 5 to which the second exemplary embodiment is applied is the same as that in the first exemplary embodiment. However, it is different that the axis center direction of the flash lamp 51 is provided substantially parallel (intersect at −10 degrees to 10 degrees) to the transportation direction of the continuous paper P.

Figure 11A:
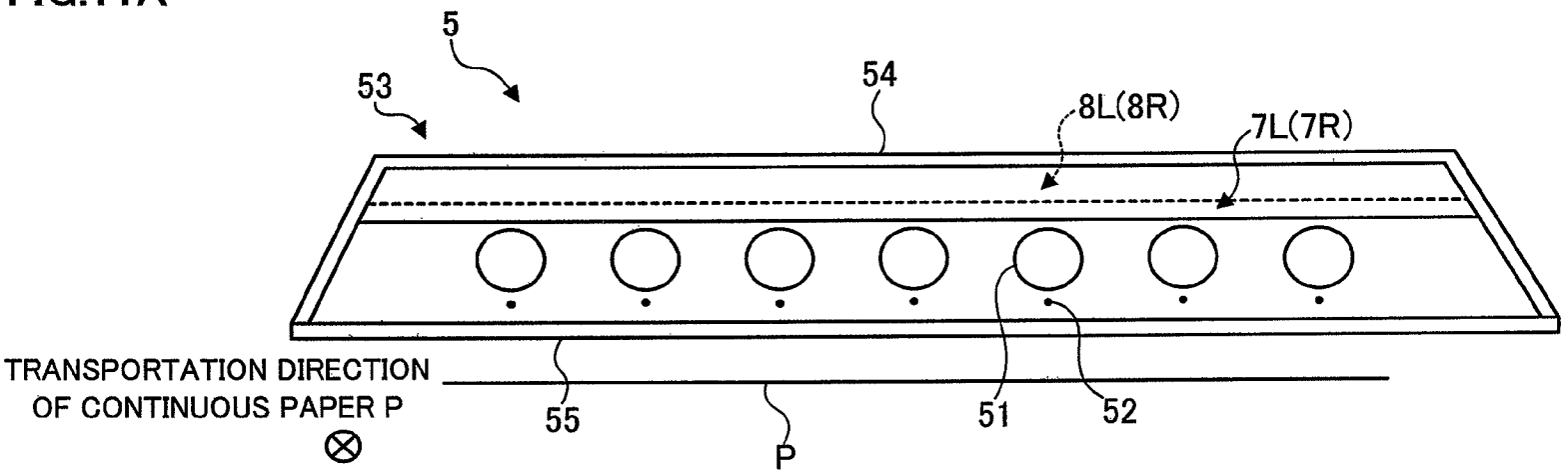
FIG. 11A is a side view that illustrates the flash fixing apparatus when viewing from the upstream side in the transportation direction of the continuous paper.
Figure 11B:
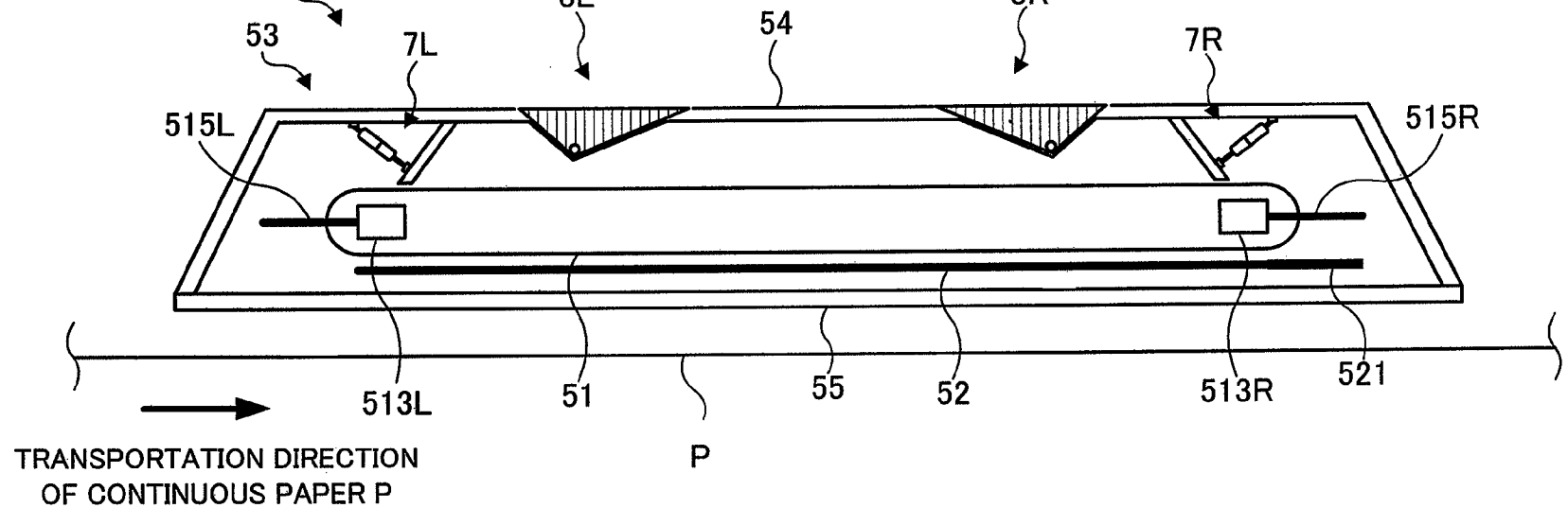
FIG. 11B is a side view that illustrates the flash fixing apparatus when viewing from a direction orthogonal to the transportation direction of the continuous paper.

FIG. 11A is a side view that illustrates the flash fixing apparatus 5 when viewing from the upstream side in the transportation direction of the continuous paper P. Further, FIG. 11B is a side view that illustrates the flash fixing apparatus 5 when viewing from a direction orthogonal to the transportation direction of the continuous paper P.

It should be noted that, as described above, the basic configuration of the flash fixing apparatus 5 is similar to the flash fixing apparatus 5 to which the first exemplary embodiment is applied. However, to the flash fixing apparatus 5 which the second exemplary embodiment is applied to, seven flash lamps 51 are attached (refer to FIG. 11A).

Incidentally, when fixing is executed using the flash fixing apparatus, it is necessary to eliminate an irradiation failure of flash light to a continuous paper (a toner image) which is transported in sequence. In order not to generate the irradiation failure of the flash light to the continuous paper, it is required to meets the equation described below.

The equation is represented by using a moving width of the continuous paper per unit time represented by H, the number of emission of the flash lamp per unit time, that is, a light emitting frequency represented by f, and the length of the flash lamp in the transportation direction of the continuous paper represented by L.

$$H=L\times f$$

That is, if the moving width of the continuous paper per unit time H is equal to a light emitting width per unit time given by L×f, the irradiation failure to the continuous paper does not occur.

However, as a general characteristic of the flash lamp, the illuminance on the end portion side of a flash lamp is decreased as compared with that around the center (refer to condition (A) in FIG. 8A). Thus, actually, an area that is irradiated with the flush light on the end side of the flash lamp by n-th emission is also irradiated with the flush light by (n+1)-th emission such that the flash light by (n+1)-th emission is overlapped (superimposed) on the flush light by n-th emission on the end side of the flash lamp. For example, if the flash light is overlapped by fixing the moving width of the continuous paper H and the length of the flash lamp L while the light emitting frequency f is changed, it is necessary to apply to a light emitting frequency f' larger than the light emitting frequency f which establishes the above-described equation. That is, by increasing the light emitting width of the flash light with respect to the moving width H, a part of the irradiated range is overlapped. Note that an overlapped width at this time is represented by H−L×f'. As this example, a change of the light emitting frequency f into the light emitting frequency f' higher than that results in, for example, an increase in the number of emission of the flash lamp with respect to the continuous paper P with a unit length. This also causes the flash lamp to be quickly consumed.

On the other hand, the flash fixing apparatus 5 to which the second exemplary embodiment is applied deforms the reflection surface of the reflection mechanism 53 in response to the number of emission of the flash lamp 51. Thus, the illuminance of the flash lamp 51 on the end portion side is equivalent to that around the center and an illuminance distribution becomes uniform as a whole. Accordingly, it is not necessary to overlap the flash light to the continuous paper P which is transported in sequence. For example, in the above-described example, it is not necessary to change the light emitting frequency f into the light emitting frequency f' higher than that.

It should be noted that, in the flash fixing apparatus 5 to which the first exemplary embodiment is applied, four flash lamps 51 are attached. Further, in the second exemplary embodiment, seven flash lamps 51 are attached. However, the number of the flash lamps 51 provided on the flash fixing apparatus 5 is not limited to these. The number of the flash lamps 51 may optionally be set in response to the width of the continuous paper P or the like.

Further, the driving mechanism used for changing the inclination of the movable reflection surface is not limited to a cylinder or a motor. Any mechanism may be used if each has a mechanism to change the inclination of the movable reflection surface.

Furthermore, in the exemplary embodiments, two threshold values of the first count value and the second count value are set, and thereby the inclination of the movable reflection surface is changed twice in total. However, the number of times and the timing for changing the inclination of the movable reflection surface are not limited to that described in the exemplary embodiments. The inclination of the reflection surface may be changed at a further close interval between the first stage and the last stage of the flash lamp 51.

Furthermore, in the exemplary embodiments, the flap reflection portions 7L and 7R, and the V-shaped reflection portions 8L and 8R are included in the reflection mechanism 53. However, the movable reflection surface to be provided on the reflection mechanism 53 is not limited to these configurations. An installation number, a shape or an attached position may be also suitably changed so that the illuminance becomes uniform to the continuous paper P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording medium;

a flash lamp that irradiates, with flash light, the recording medium on which the image is formed in the image forming unit;

a reflection member that has a fixed reflection member fixedly arranged on the flash lamp and a rotary reflection member rotatably attached to the fixed reflection member, and reflects the flash light irradiated from the flash lamp to the recording medium;

a counter unit that measures the number of emission of the flash lamp; and an instruction unit that instructs the reflection member to change an attachment angle of the rotary reflection member to the fixed reflection member in response to the number of the emission measured by the counter unit.

2. The image forming apparatus according to claim 1, wherein the instruction unit instructs the reflection member to move an arrival position of the flash light reflected by the rotary reflection member from the outside of the end portion of the recording medium to the end portion side in response to an increase of the number of the emission.

3. The image forming apparatus according to claim 1, wherein the flash lamp has a linear shape, and an axis center direction of the flash lamp is arranged along a transportation direction of the recording medium.

4. A fixing apparatus used in an image forming apparatus and fixing an image on a recording medium, the fixing apparatus comprising:

a flash lamp that emits flash light for fixing the image;

a reflection member that has a reflection surface reflecting the flash light emitted from the flash lamp to the recording medium, a shape of the reflection surface being configured so as to be deformable; and a counter unit that measures the number of emission of the flash lamp, wherein the reflection surface is deformed in response to the number of the emission measured by the counter unit.

5. The fixing apparatus according to claim 4, wherein the reflection member comprises:

a fixed reflection member that has a fixed reflection surface whose position is fixed relative to the flash lamp; and a movable reflection member that has a movable reflection surface whose position is changeable relative to the flash lamp.

6. The fixing apparatus according to claim 5, wherein the flash lamp has a linear shape, and the movable reflection member comprises:

a first movable reflection member provided on one end side in an axis direction of the flash lamp; and a second movable reflection member provided on the other end side in the axis direction of the flash lamp.

7. The fixing apparatus according to claim 6, wherein the first movable reflection member comprises:

a first reflection surface that opposed to one end side of the flash lamp; and a second reflection surface that opposed to the other end side of the flash lamp, the second movable reflection member comprises:

a third reflection surface that opposed to the one end side of the flash lamp; and a fourth reflection surface that opposed to the other end side of the flash lamp, each of the first and the fourth reflection surfaces has an angle formed with the fixed reflection surface that is decreased in response to an increase of the number of emission of the flash lamp, and each of the second and the third reflection surfaces has an angle formed with the fixed reflection surface that is increased in response to an increase of the number of emission of the flash lamp.

* * * * *